US005738390A

United States Patent [19]

Yemini

[11] Patent Number: 5,738,390

[45] Date of Patent: Apr. 14, 1998

[54] HINGEABLE LATCH

[75] Inventor: Evi Yemini, Tel-Aviv, Israel

[73] Assignee: Zag Ltd., Rosh Haayin, Israel

[21] Appl. No.: 815,542

[22] Filed: Mar. 12, 1997

[51] Int. Cl.[6] ..... E05C 19/06

[52] U.S. Cl. ..... 292/87; 292/DIG. 16; 16/232

[58] Field of Search ..... 292/87, 101, DIG. 38, 292/DIG. 16; 16/232, 231

[56] References Cited

U.S. PATENT DOCUMENTS 2,349,486 5/1944 Crosman ..... 16/232
2,472,285 6/1949 Claud-Mantle ..... 16/232
4,985,962 1/1991 Weber ..... 292/87

*Primary Examiner*—Flemming Saether
*Attorney, Agent, or Firm*—Mark M. Friedman

[57] ABSTRACT

A hingeable latch for detachably or hingedly connecting a base and a cover, most particularly as part of a box. The cover includes a rod and a latch plate which is mounted on the rod so that the latch plate is rotatable relative to the rod. The base includes a latch catch which is designed to engage a portion of the catch plate so as to connect the base and cover. The base further features a rod seat which is designed to hingedly accommodate at least a portion of the rod so that when the latch plate and the latch catch are engaged, the rod is rotatable in the rod seat to permit the cover to be hinged relative to the base.

4 Claims, 6 Drawing Sheets

HINGEABLE LATCH

FIELD AND BACKGROUND OF THE INVENTION

The present invention relates to latches such as might be used to connect a tool box cover to the base of the toll box and, in particular to latches which can alternately serve as hinges so as to allow the cover to be either entirely removed from the base or hinged to it.

The proposed invention has several applications, including, but not limited to a tool box and a picnic cooler. The boxes are characterized in that they include a base portion into which the items to be housed and/transported are placed and a cover which securely fits onto the base portion to protect the contents and prevent their inadvertent spillage from the box.

Two types of boxes are currently available which may be categorized for the purpose of the present invention into boxes with covers which are permanently hinged onto their bases and those boxes whose covers are designed to be completely removed from their base.

Depending on the specific application, one or the other of these cover types may be preferred. The ability to completely remove the cover of the box is desirable, for example, when it is important to gain free and completely unimpeded access to the inside of the box. On the other hand, the use of a cover which is hinged to the base is convenient in that it makes for easier opening and dosing of the box in those application where the box needs to be repeatedly be opened and closed.

In some cases, however, it may be desirable to be able to open the same box in either of the two ways mentioned above. Thus, it may be deskable, for example, to open the box by hinging its cover in order to remove or add one or a few small items. Conversely, it may desirable to completely remove the cover in order to remove or add many items or large items or, for example, to add or remove shelving or other partitions which define the storage space of the box.

There is thus a widely recognized need for, and it would be highly advantageous to have, a box whose cover can easily and readily be either hinged to the box or completely removed from the box.

SUMMARY OF THE INVENTION

According to the present invention there is provided a hingeable latch for detachably or hingedly connecting a base and a cover, comprising: (a) a rod connected to, or integrally formed with, the cover; (b) a latch plate mounted on the rod so that the latch plate is rotatable relative to the rod; (c) a latch catch connected to, or integrally formed with, the base, the latch catch designed to engage a portion of the catch plate so as to connect the base and cover; and (d) a rod seat connected to, or integrally formed with, the base, the rod seat designed to hingedly accommodate at least a portion of the rod so that when the latch plate and the latch catch are engaged, the rod is rotatable in the rod seat to permit the cover to be hinged relative to the base.

Also according to the present invention, there is provided a box having a box base and a box cover, comprising at least one hingeable latch for detachably or hingedly connecting the box base and the box cover, the at least one hingeable latch including: (a) and connected to, or integrally formed with, the box cover; (b) a latch plate mounted on the rod so that the latch plate is rotatable relative to the rod; (c) a latch catch connected to, or integrally formed with, the box base, the latch catch designed to engage a portion of the catch plate so as to connect the box base and the box cover; and (d) a rod seat connected to, or integrally formed with, the box base, the rod seat designed to hingedly accommodate at least a portion of the rod so that when the latch plate and the latch catch are engaged, the rod is rotatable in the rod seat to permit the box cover to be hinged relative to the box base.

According to further features in preferred embodiments of the invention described below, portions of the rod extend beyond the latch plate and wherein the rod seat hingedly accommodates the portions of the rod.

According to still further features in the described preferred embodiments the box includes at least a first pair and a second pair of the hingeable latches, the at least first pair of hingeable latches being located on one side of the box and the at least second pair of hingeable latches being located on an opposing side of the box.

The present invention successfully addresses the shortcomings of the presently known configurations by providing a hingeable latch which makes it possible to quickly and readily alternately hinge the cover of a box or completely remove the cover of the box, as desired.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a hingeable latch which can be used to allow a container to be opened either by removing the container's cover or by hinging the cover about one or more hingeable latches which connect the cover to the base.

The principles and operation of a hingeable latch according to the present invention may be better understood with reference to the drawings and the accompanying description.

Figure 1:
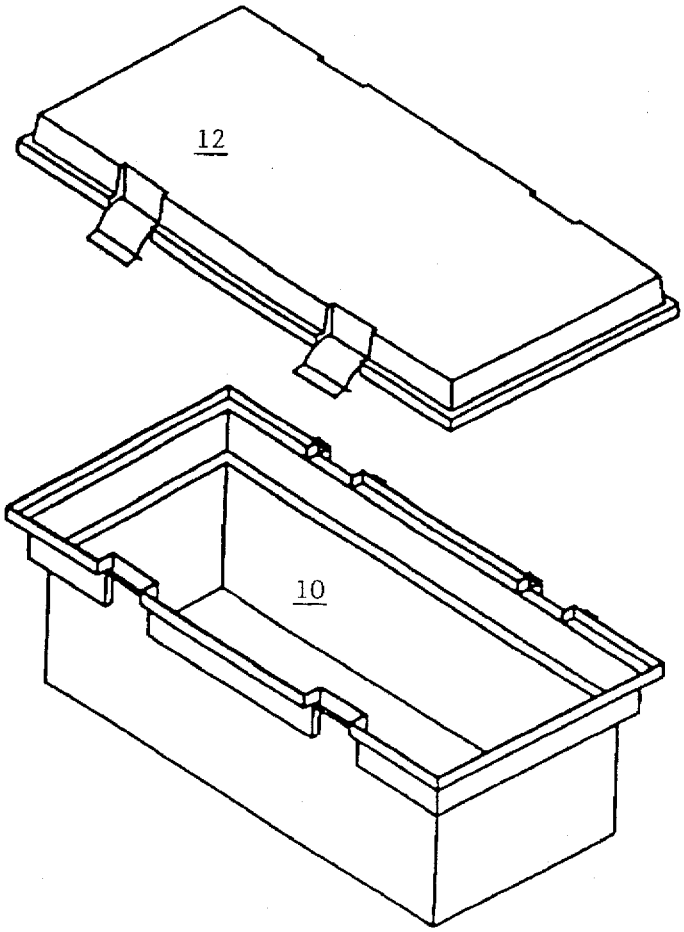
FIG. 1 is a perspective view of a box utilizing at least a pair of hingeable latches according to the present invention when the cover has been removed from the base.
Figure 2:
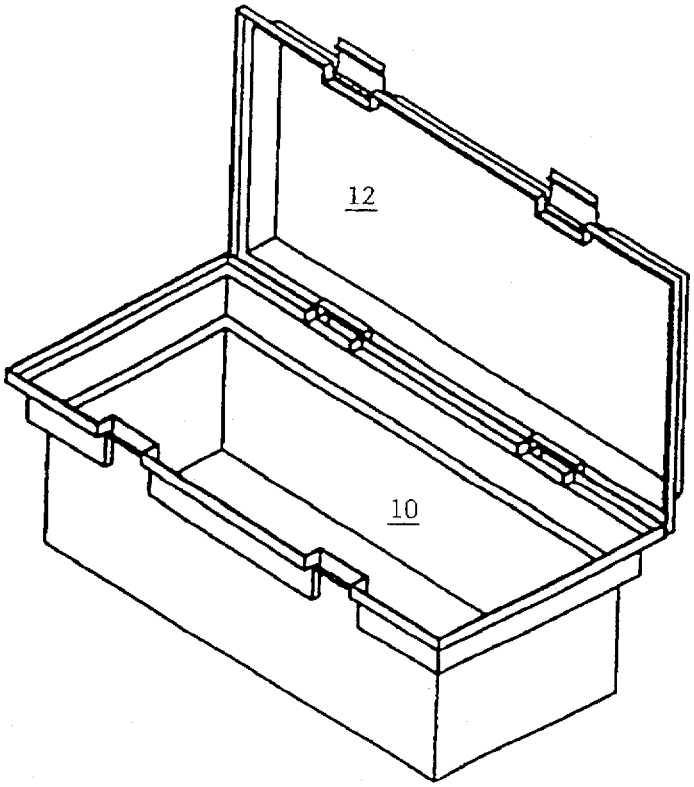
FIG. 2 is a perspective view of the box of FIG. 1 but with the cover hinged about a pair of hingeable latches.

Referring now to the drawings, FIGS. 1 and 2 illustrate a box, such as a tool box, a picnic cooler, and the like, using one or more hingeable latches according to the present invention.

The box includes two main components—a base 10 and a cover 12. As used herein, base 10 is the lower portion of the box which is intended to house the contents of the box.

Base 10 and cover 12 are connected together with the help of latches. Some of these latches may be conventional non-hingeable latches as described below but the latches on at least one side of the box are hingeable latches according to the present invention, as described in more detail below. For example, the pair of latches toward the front of the box in FIGS. 1 and 2 may be either conventional non-hingeable latches or hingeable latches according to the present invention while the pair of latches toward the rear of the box in FIGS. 1 and 2 are hingeable latches according to the present invention.

Figure 3A:
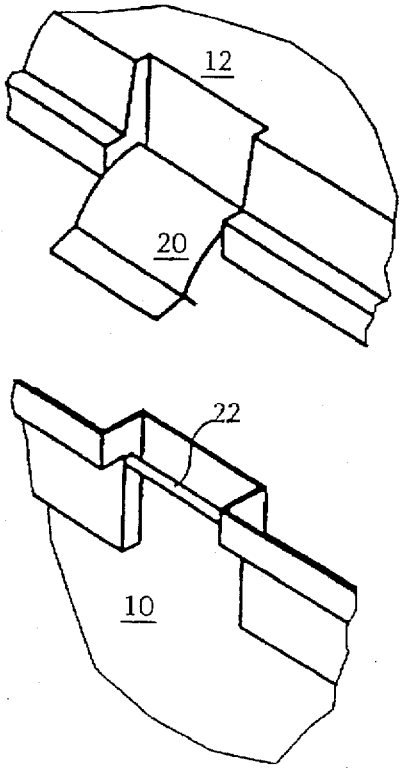
FIG.3A PRIOR ART
FIG. 3A is a close-up view of one type of prior art non-hingeable latch which might be used for one side of a box such as that shown in FIGS. 1 and 2.
Figure 3B:
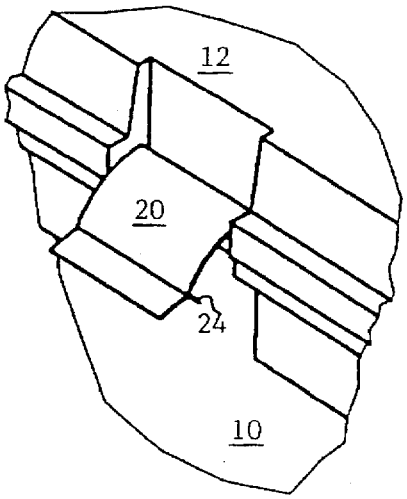
FIG.3B PRIOR ART
FIG. 3B is a view of the non-hingeable latch of FIG. 3A with the cover resting on the base but prior to engaging the latch.
Figure 3C:
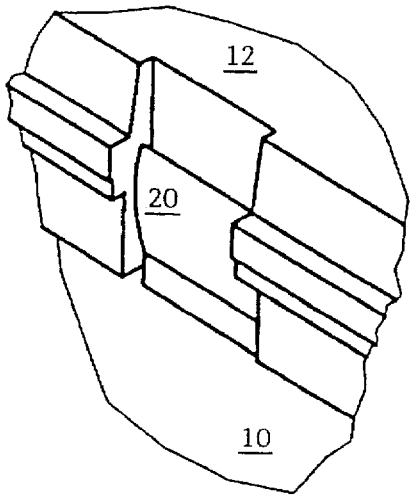
FIG.3C PRIOR ART
FIG. 3C is a view of the non-hingeable latch of FIG. 3A with the cover resting on the base and after the latch has been engaged.

One known type of conventional non-hingeable latch is shown in FIGS. 3A—3C. As can be seen in FIG. 3A, a latch plate 20 is rotationally mounted on a rod (not shown) which is connected to, or integrally formed with cover 12. A latching rod 22, or similar feature, is connected to, or integrally formed with, base 10. To lock base 10 and cover 12 together, base 10 and cover 12 are brought together (FIG. 3B) and latch plate 20 is rotated, using adequate force, so that a protrusion 24 of latch plate 20 catches latching rod 22 and locks latch plate 20 and latching rod 22 together. To separate base 10 and cover 12 latching plate 20 is simply rotated away, using adequate force, so as to disengage protrusion 24 of latch plate 20 from latching rod 22.

Shown in FIGS. 4–6 is one example of a hingeable latch according to the present invention.

A hingeable latch according to the present invention includes a rod 30, which is preferably substantially circular in cross section. Rod 30 is connected to, or, preferably, integrally formed with, cover 12.

The hingeable latch further includes a latch plate mounted on rod 30 so that latch plate 20 is, to some degree, rotatable about rod 30.

Connected to, or, preferably, integrally formed with, base 10 is a latch catch 40 which is designed to engage a portion of latch plate 20 so as to connect base 10 and cover 12. The portion of latch plate 20 in question is preferably a protrusion 42 which is dimensioned to engage latch catch 40, which may be in the form of a lip, when latch plate 20 is rotated about 30 with sufficient force to effect the engagement.

Finally, connected to, or, preferably integrally formed with, base 10 is a rod seat 50 which is designed to hingedly accommodate at least a portion of rod 30. Preferably, as in the illustrated embodiment rod 30 extends in both directions beyond the edges of latch plate 20 and it is these extending portions which are accommodated in rod seat 50. However, other configurations (not shown) may be envisioned wherein the portion of the rod which is accommodated by the rod seat is an interior portion of the rod, for example, where a portion of the rod between the two edges of the latch plate is exposed through appropriate design of the inward-facing surface of the latch plate.

Figure 4A:
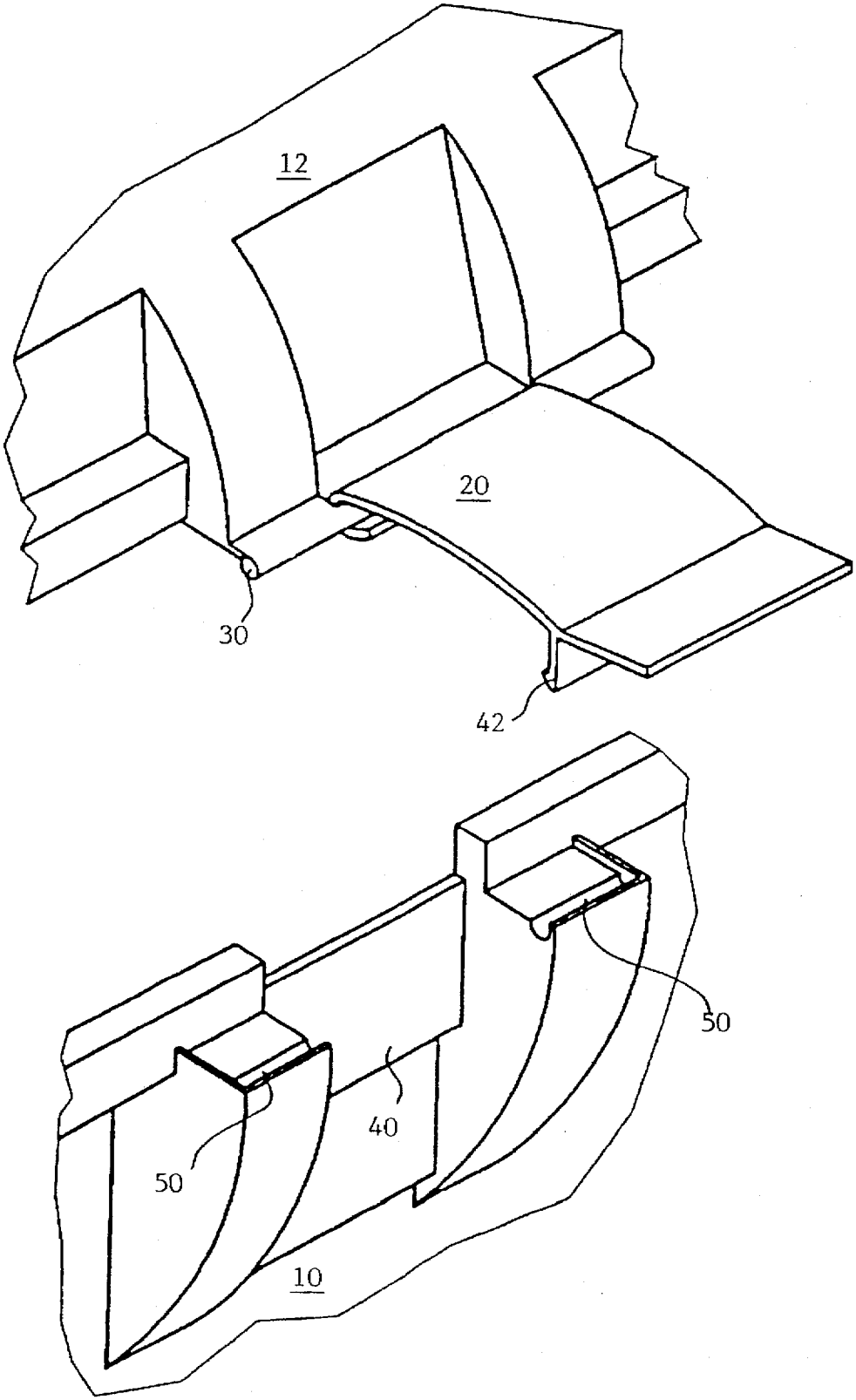
FIG. 4A is a close-up view of an example of a hingeable latch according to the present invention with the cover removed from the base.
Figure 4B:
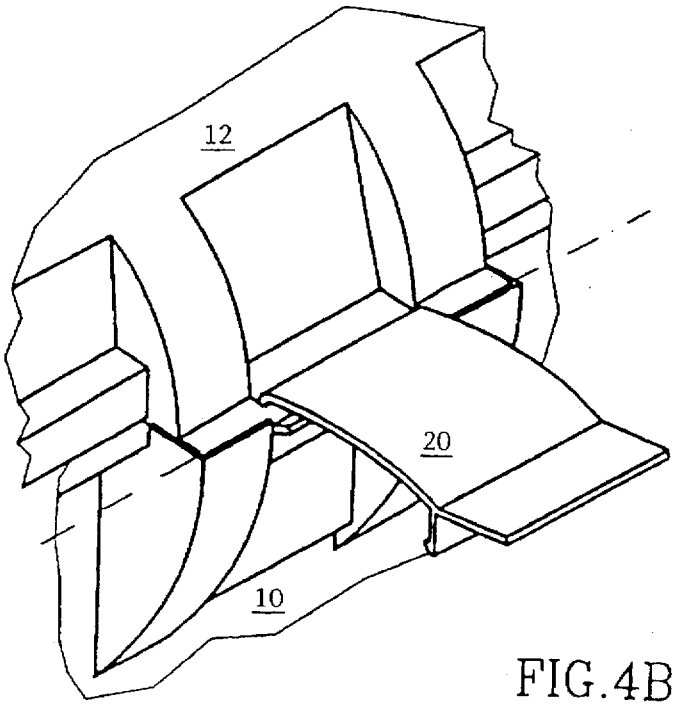
FIG. 4B is a view of the latch of FIG. 4A with the cover resting on the base but prior to engaging the latch.
Figure 4C:
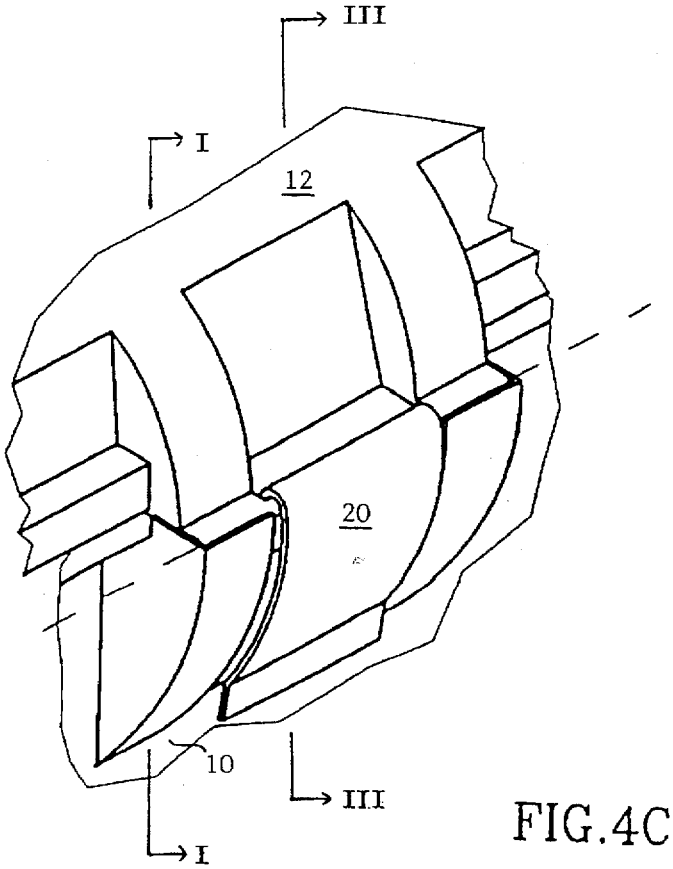
FIG. 4C is a view of the latch of FIG. 4A with the cover resting on the base after the latch has been engaged.

In FIG. 4B base 10 and cover 12 have been brought together. The broken line in FIGS. 4B–4D indicate the axis of rod 30 which is not clearly visible in these figures.

Figure 5A:
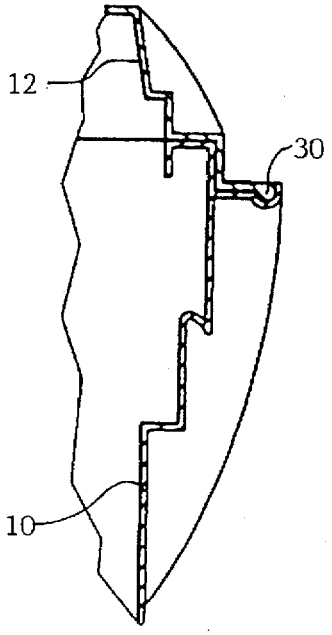
FIG. 5A is a cross-sectional view along section line I—I in FIG. 4C.
Figure 6A:
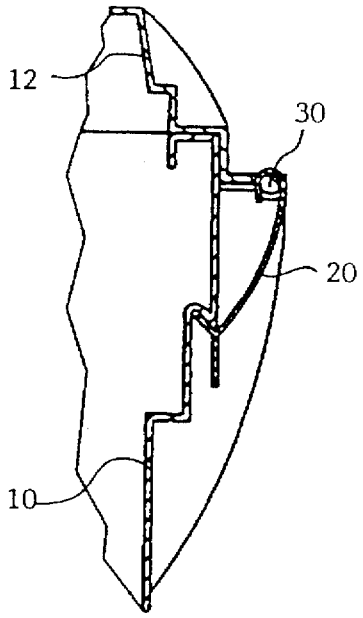
FIG. 6A is a cross-sectional view along section line III—III in FIG. 4C.

Once base 10 and cover 12 have been properly brought together, latch plate 20 can be forcefully rotated about rod 30 so as to cause latch plate 20 to engage latch catch 40, thereby connecting base 10 and cover 12 together (FIG. 4B). To further elucidate the mechanism, FIGS. 5A and 6A are provided which show cross-sectional views of the hingeable latch along the section lines I—I and III—III, respectively, of FIG. 4C.

Figure 4D:
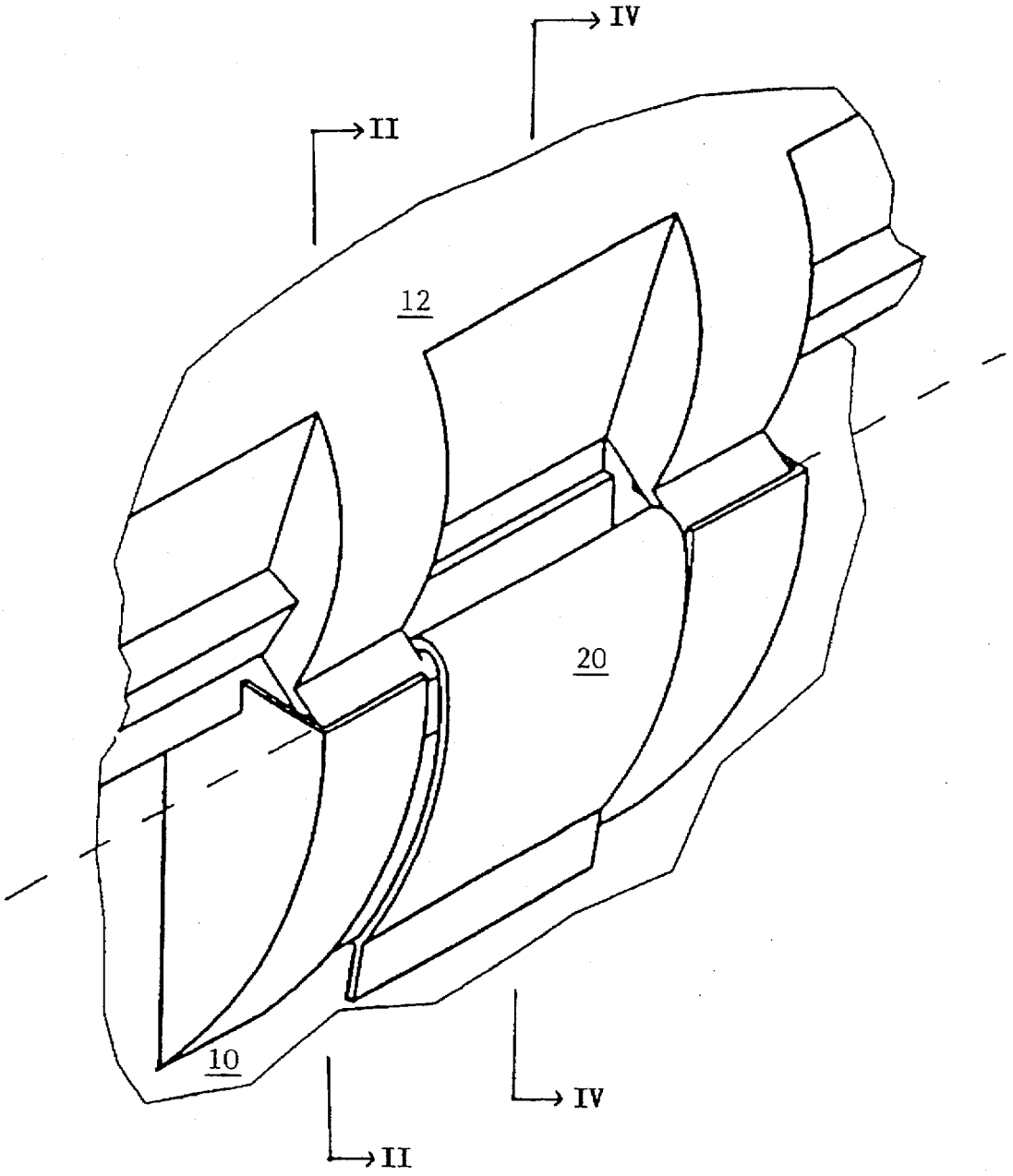
FIG. 4D is a view of the latch of FIG. 4A after the latch has been engaged but with the cover pivoted open about the latch.
Figure 5B:
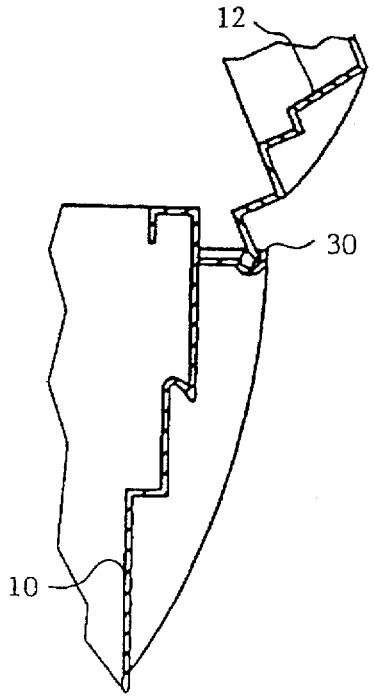
FIG. 5B is a cross-sectional view along section line II—II in FIG. 4D.
Figure 6B:
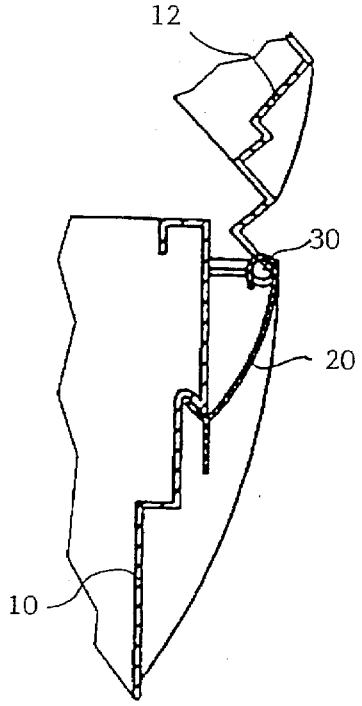
FIG. 6B is a cross-sectional view along section line IV—IV in FIG. 4D.

The locking of the hingeable latch as described above resembles the locking of a conventional non-hingeable latch, such as the one illustrated in FIGS. 3A–3C. Thus, the locking of the hingeable latch serves to securely connect base 10 and cover 12 together, just as in the case of a conventional latch. However, unlike a conventional non-hingeable latch, a hingeable latch according to the present invention is unique in that, after the latch has been fully locked (FIG. 4C) cover 12 may be readily hinged relative to base 10 about the latch (FIG. 4D). To further elucidate the mechanism, FIGS. 5B and 6B are provided which show cross-sectional views of the hingeable catch along the section lines II—II and IV—IV, respectively, of FIG. 4D.

As will readily be appreciated, the positions of the latch plate and rod may be interchanged with those of the latch catch and rod seat. Thus, for example, in certain applications it may be desirable to have the latch plate and rod associated with the base while the latch catch and rod seat are associated with the cover. The opposite configuration was selected herein for ease of exposition.

Hence, throughout the specification and in the claims the words 'base' and 'cover' are to understood merely to represent two bodies which are to be hingedly latched to each other without regard to which, if either, of the two bodies serves to cover the other. Thus, the claims are intended to cover hingeable latches and boxes regardless of whether the latch plate and rod are associated with the upper or lower bodies and regardless of whether one of the bodies actually serves as a base while the actually serves as a cover.

A box according to the present invention must have at least one latch on each of two opposing sides :of the box with at least one of these latches being a hingeable latch according to the present invention.

Preferably, a box according to the present invention includes two or more latches on each of two sides of the box with all the latches on at least one side being hingeable latches according to the present invention.

When the latches on one side of the box are hingeable latches while the latches on the opposite side are conventional non-hingeable latches care must be taken in opening the box to open the conventional latches if, the cover is to be hinged. Thus, the latching system in this case has a certain directionality in that the various latches are not equivalent. To aid the user, it may be desirable to provide certain visual indicators as to which latches to open if the cover is to be hinged.

In an alternative embodiment, all the latches, i.e., the latches on both sides of the box, are hingeable latches. In this case, the cover may be hinged by opening the latches on one or the other sides of the box, thereby obviating the need to provide the user with information regarding the directionality of the box and further enhancing the usefulness and versatility of the box by allowing the box to be hingedly opened in either direction.

While the invention has been described with respect to a limited number of embodiments, it will be appreciated that many variations, modifications and other applications of the invention may be made.

What is claimed is:

1. A hingeable latch utilizing a single mobile element for detachably or hingedly connecting a base and a cover, comprising:

(a) a single rod connected to, or integrally formed with, the cover;

(b) a latch plate mounted on said rod so that said latch plate is rotatable relative to said rod;

(c) a latch catch connected to, or integrally formed with, the base, said latch catch including a lip designed to engage a protrusion of said latch plate, being at a substantially acute angle to said latch plate, so as to connect the base and cover; and (d) a rod seat connected to, or integrally formed with, the base, said rod seat designed to hingedly freely accommodate at least a portion of said rod so that when said latch plate and said latch catch are engaged, said rod is rotatable in said rod seat to permit the cover to be hinged relative to the base, wherein portions of said rod extend beyond said latch plate and wherein said rod seat hingedly accommodates said portions of said rod.

2. A box having a box base and a box cover, comprising at least one hingeable latch utilizing a single mobile element for detachably or hingedly connecting the box base and the box cover, said at least one hingeable latch including:

(a) a single rod connected to, or integrally formed with, the cover;

(b) a latch plate mounted on said rod so that said latch plate is rotatable relative to said rod;

(c) a latch catch connected to, or integrally formed with, the base, said latch catch including a lip designed to engage a protrusion of said latch plate, being at a substantially acute angle to said latch plate, so as to connect the base and cover; and (d) a rod seat connected to, or integrally formed with, the base, said rod seat designed to hingedly freely accommodate at least a portion of said rod so that when said latch plate and said latch catch are engaged, said rod is rotatable in said rod seat to permit the cover to be hinged relative to the base, wherein portions of said rod extend beyond said latch plate and wherein said rod seat hingedly accommodates said portions of said rod.

3. The box of claim 2, wherein said box includes at least one pair of said hingeable latches said at least one pair of hingeable latches being located on one side of the box.

4. The box of claim 2, wherein said box includes at least a first pair and at least a second pair of said hingeable latches, said at least first pair of hingeable latches being located on one side of the box and said at least second pair of hingeable latches being located on an opposing side of the box.

* * * * *